United States Patent [19]

Palmer et al.

[11] 4,037,186

[45] July 19, 1977

[54] CONNECTING AND SWITCHING SYSTEM, AND SWITCHING APPARATUS SUITABLE FOR USE THEREIN

[75] Inventors: James E. Palmer, Moorestown; Donald C. Lavallee, Haddon Heights; George Huber, Mount Laurel, all of N.J.

[73] Assignee: Spectron Corporation, Mount Laurel, N.J.

[21] Appl. No.: 656,597

[22] Filed: Feb. 9, 1976

[51] Int. Cl.[2] ..... H01R 33/30; H01H 5/02

[52] U.S. Cl. ..... 335/206; 200/51.1; 200/51.09

[58] Field of Search ..... 200/51.09, 51.1; 335/206, 207

[56] References Cited

U.S. PATENT DOCUMENTS

| | | | |
|---|---|---|---|
| 3,475,569 | 10/1969 | Glaudot | 200/51.09 X |
| 3,496,500 | 2/1970 | Romary | 200/51.09 X |

*Primary Examiner*—Thomas J. Kozma
*Attorney, Agent, or Firm*—Howson and Howson

[57] ABSTRACT

A first set of conductors (e.g. 25 of them) leading for example to a communications modem, is connected by way of a corresponding set of normally-closed switches to corresponding conductors of a second set, leading for example to local equipment such as a computer. At least one of the above sets of conductors is also connected to connector means into which a multi-wire (e.g. 24 wire) patching cable may be plugged. The plugging-in of the patching cable automatically opens the normally-closed switches to isolate the first and second sets of conductors from each other, as is usually desired for patching purposes. Preferably the switches are magnetically-operable reed switches, switched between their open and closed states by magnet means controlled by the plugging-in of the patching cable. Preferably the plugging-in moves the magnet means physically from a position near the switches for which the switches are operated to one of their states, to a position more remote from the switches for which the switches assume their opposite state. In a preferred embodiment the magnet means are mounted on a slidable panel, which is moved slidably by a protruding tab on the patching-cable plug when the plug is inserted, and the panel is returned to its original position by a spring when the plug is removed. Patching of many-conductor cables is thereby made possible with a simple single motion by the operator, and with reliable and relatively inexpensive apparatus.

15 Claims, 9 Drawing Figures

CONNECTING AND SWITCHING SYSTEM, AND SWITCHING APPARATUS SUITABLE FOR USE THEREIN

BACKGROUND OF THE INVENTION

This invention relates to apparatus and method for patching and/or switching multiple-wire electrical interfaces, and especially to such apparatus in which mere insertion of a plug member not only makes a desired connection to a first set of conductors but also temporarily breaks a pre-existing connection of the first set of conductors to a second set of conductors.

There are many important applications, particularly in the communications field, in which it is necessary to open a normal connection between a first set of one or more conductors and a second set of corresponding conductors, and to connect one or both of said sets instead to a third corresponding set of conductors. For example, in telephone and telegraphs systems it has long been common practice to terminate a large number of communications lines, each for example consisting of two or four wires, in corresponding large arrays of receptacles or jacks. These receptacles or jacks have often included not only means for making quick connection to, and disconnection from, the wires of a particular line by the insertion of an appropriate plug into the corresponding jack but typically also include means establishing a normal connection between wires of that line and wires of another line through switch contact associated with and integral to each of the jacks, which normal connection is automatically interrupted when the plug is inserted. Thus the jacks and their contacts, as well as the plug, conventionally are designed and arranged in such a way that when a so-called "patch cord" plug is inserted into a jack, the switch contacts of the jack are thereby moved to interrupt the normal connection and to transfer the connection through the plug to the patch cord. By such means it is possible, by simple insertion of the plug, not only to interrupt an existing connection, but to transfer that connection to whatever equipment or communications line may be connected to the other end of the patch cord.

With such arrangements it is easy to use the patch cord to rearrange the interconnections of communications lines, to disconnect and reconnect various communications devices associated with those lines, and in general to facilitate diagnosis of faults, performing of tests, making of electrical measurements, substituting of good lines for bad, and restoring of service in case of service outage. Systems embodying such jack fields and plug arrangements are generally referred to as technical control systems, or, for short, tech control systems. Such systems have typically been found in large telephone or telegraph central stations, where high concentrations of communications channels exist.

Difficulties with such conventional approaches increase markedly when the number of wires in the communications lines increase beyond a few. Thus while it has been possible to operate in this manner on lines containing several wires by appropriate design of plug and jack, and while it is possible to bond together a number of plugs to be inserted into a small physical array of adjacent jackes to accomplish similar purposes, as the number of wires involved increases substantially, for example up to 12, 24, or even more wires, problems of increasing bulk, decreasing reliability and increasing cost have made this conventional approach infeasible.

However, in recent years the desirability of such a patching and switching capability for communications lines containing large numbers of wires has become apparent. For example, particularly with the advent of data communications systems operating in conjunction with computers, it has become common to find a number of communications lines terminating on the premises of end-users where one or more computers or other type of local equipment may be in use. Such local equipment is usually connected to the communications lines through modems which convert signals emanating from the local equipment into a form suited to transmission over the communications lines, and vice versa. The connection between such modems and the local equipment is typically made through many-wired lines. Although the number of communications lines at an end-user site is typically smaller than the number of lines at a telephone or telegraph central station, there is just as great a need for flexibility in diagnosis, repair, and restoration of service. In such situations the capability of providing a patching facility for many-wired lines becomes important.

One particular application in connection with which the invention will be specifically described in the interest of definiteness, is one in which coded audio-frequency tone signals are transmitted over several public carrier lines such as telephone lines, to end-user premises, where a modem converts the audio signals on each communication line into digital electrical signals on a corresponding many-wired line for delivery to a local equipment such as a corresponding computer. For example, at a given end-user site there may be a plurality of computers or other local equipment, and/or a plurality of modems including some spare modems not ordinarily in use. The many-wired lines (e.g. 24 wires) which connect each modem with its corresponding local equipment may then be brought out to corresponding front receptacles on a technical control system, so that they can be monitored by plugging into the appropriate receptacle. However, in addition it is often desirable to perform switching and patching functions to change which local equipment is connected to which modem, to bypass a possible faulty modem and replace it with a spare modem, or for any of many other similar functions.

One approach which has been used to provide such a patching function for many-wired lines involves connecting the wires from a given modem to the wires leading to a corresponding local equipment by way of normally-closed switch contacts within the technical control system; connecting the line on the modem side of the switch and the line on the local equipment side of the switch to contacts at corresponding front receptacles in the tech control system where contact to them can be made by suitable corresponding plugs; and providing a shaft extending through the front panel of the tech control system which can be rotated by an operator between a "normal" position in which the internal switch contacts are closed so as to interconnect modem and local equipment internally, and a "patch" position in which the latter connections are broken and a patch cord may be used to connect the contacts at either of the two front receptacles to any other receptacle to accomplish any type of switching or monitoring operation which is desired. This arrangement not only requires a relatively costly multiple-contact manually operable switching arrangement, but in addition requires that the operator performing the patching function himself execute a further necessary operation before he can accomplish patching, namely the turning of the control to the patching position. This not only requires additional effort, but may result in improper connections in the event that the operator should forget to turn the switch to the appropriate position.

The only other available method known by applicant for performing such a function for many-wired lines involves a method practiced by Cooke Engineering Company, a division of Dynatech Laboratories, Inc., of Virginia. It involves the use of normally-closed sets of contacts within a receptacle, and a relatively long wand having a number of contacts arranged linearly along it. The internal normally-closed contacts are arranged in a correspondingly-linear arrangement along the receptacle, into which receptacle the wand is inserted endwise and then rotated about its longitudinal axis. This establishes electrical connection between the contacts on the wand and the contacts within the receptacle, while at the same time opening the internal normally-closed contacts. However, this arrangement has not been found practical with more than about 16 wires, and in addition requires that the user not only insert the wand but also turn it in order to obtain the desired objective.

Accordingly, it is an object of the invention to provide new and improved apparatus and method for controlling the connection of a first plurality of wires to a second plurality of wires.

Another object is to provide such method and apparatus which provides controlled connection of said first plurality of wires to said second plurality of wires and to a third plurality of wires.

A further object is to provide such apparatus and method in which connection of said third plurality of wires to said first plurality of said wires automatically disconnects said second plurality of wires from said first plurality of wires.

Another object is to provide such method and apparatus which are relatively easy to manufacture and relatively inexpensive as well as reliable.

Still another object is to provide an improved method and apparatus for providing a patching capability for many-wired lines, and which is particularly simple to operate and use.

SUMMARY OF THE INVENTION

In accordance with the invention, these and other objects are achieved by the provision of magnetically-actuatable switch means connected to a plurality of conductors, magnet means positioned adjacent said switch means to control the actuation thereof, quick-disconnect connector means for making removable connection to said conductors, and means responsive to placement of said connector means in its connecting position for controlling the magnet means to actuate the switch means between its open and closed states. Preferably the controlling of the magnet means is accomplished by physically moving it, in response to placing of said connector means in said position, between a position in which said magnet means operates the switch means to one state and another position which operates the switch means to its other state. Preferably the magnet means are of the permanent magnet type and are positioned and supported so as to be mechanically moved in response to urging by an engaging member on the connector means when the connector means is moved into its connecting position. Preferably also, the magnet means are mounted on a panel which is slidable with respect to the contacts of the switch means, and the panel is engaged and moved along one direction by a tab secured to the connector means, the panel being returned along the opposite direction by appropriate spring means when the connector means is removed. The magnetically-operable switch means are preferably reed switches of conventional known form.

In a preferred embodiment of the invention, a first plurality of conductors are connected through normally-closed contacts of the switch means to a second plurality of conductors, for example so as to connect a modem to a local equipment such as a computer during normal operation. Each of the first and second plurality of wires are preferably brought out to respective connector receptacles available for the insertion of means of the above-mentioned type, which connector means preferably is in turn connected to a many-wired patch cord having another similar connector means at its opposite end. The arrangement is preferably such that insertion of such a connector means into either of the connector receptacles will automatically open the contacts of the internal switch means, and in a preferred form a plurality of connector receptacles are so positioned with respect to the same magnet-supporting panel that insertion of the connector means into either of said receptacles will cause said tab to engage and slidably move the panel and magnet means so as to operate said switch means to its alternate state, in this example to its open state.

With the latter arrangement, patching can be accomplished between receptacles connected to different lines and different sets of switch means so as to facilitate monitoring, disconnecting, interchanging, bypassing, or substituting of various local equipment, modems, monitoring or testing equipment, etc. without requiring any operator action other than insertion of the appropriate connector means.

DESCRIPTION OF SPECIFIC EMBODIMENTS

These and other objects and features of the invention will be more readily understood from a consideration of the following detailed description, taken together with the accompanying drawings, in which.

Figure 1:
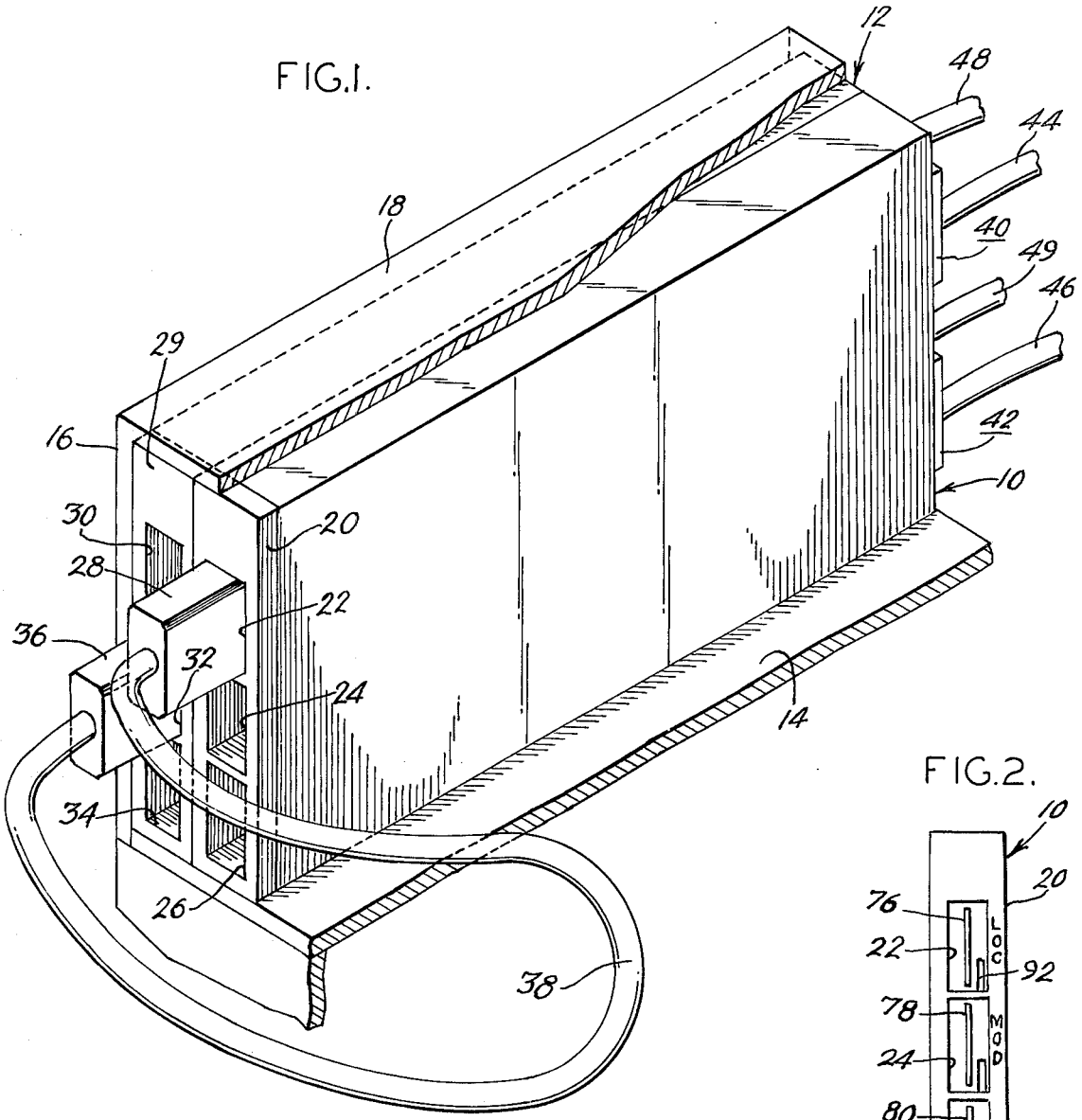
FIG.1 is a perspective view of patching apparatus embodying the invention.
Figure 2:
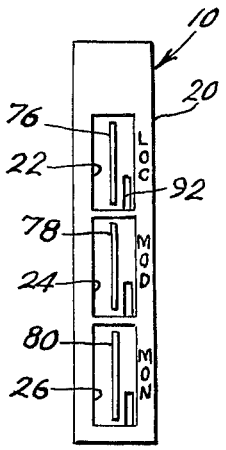
FIG. 2 is a front view of one of the two modules contained in the apparatus of FIG. 1.
Figure 3:
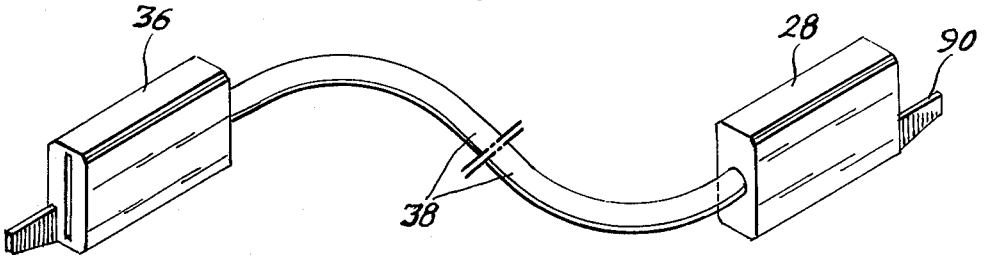
FIG. 3 is a perspective view of a patch cord assembly including a patch cord and a switch-actuating connector means at each end, usable in accordance with the invention as described hereinafter.

Referring now particularly to the embodiment of the invention shown in the drawings by way of example only, FIG. 1 shows a pair of connecting and switching modules 10 and 12 positioned within a cabinet or frame comprising a lower platform 14, a side panel 16, and a top panel 18. Module 10 is provided with a connector-guiding front receptacle 20 having three vertically-stacked and horizontally-extending receptacle chambers 22, 24 and 26 each suitable for receiving and guiding connector means in the form of a plug 28. Similarly a front receptacle 29 on module 12 is provided with three corresponding and similarly-arranged receptacle chambers 30, 32 and 34, suitable for receiving connector means in the form of plug 36. A multiple-wire flexible cord 38 interconnects the two plugs 28 and 36 (which may be identical), completely the patching cord assembly as shown in FIG. 3. Either of the plug members 28 and 36 may be operatively inserted into any of the 6 receptacle chambers shown.

On the rear of module 10 there is provided a pair of multiple-wire connectors 40 and 42, each connected to a respective set or plurality of wires contained in respective lines or cables 44 and 46. Similar lines 48 and 49 are connected to similar corresponding connectors (not shown) at the rear of module 12.

Similar additional modules may be placed beside those shown, or on higher or lower supporting shelves for example, and the patch-cord plugs 28 and 36 may also be operatively inserted into the receptacle chambers of any of these modules, as desired.

Figure 9:
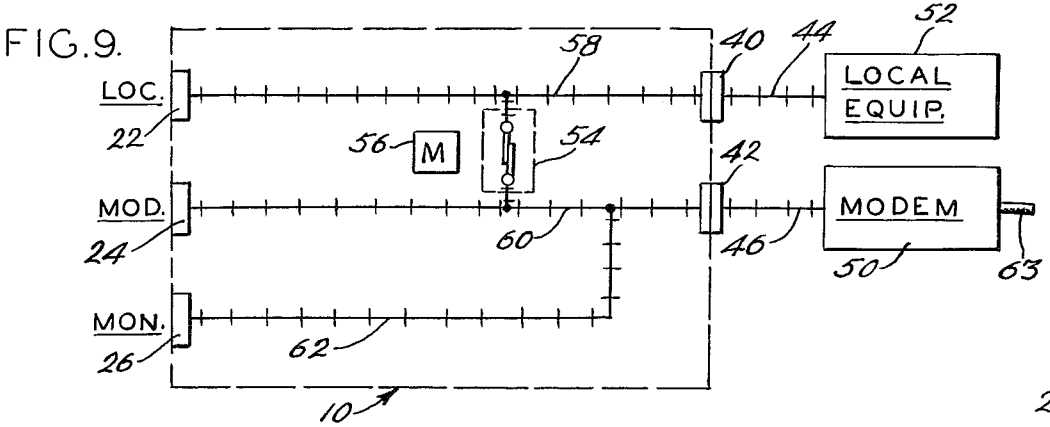
FIG. 9 is a schematic diagram illustrating a typical electrical interconnection of the system shown in the other figures.

A typical use of the apparatus shown in FIG. 1 will be more reaily appreciated from a consideration of the schematic diagram of FIG. 9, in which parts corresponding to those in FIG. 1 are indicated by corresponding numerals. In FIG. 9, a modem 50 is shown connected over line 46 to rear connector 42 of module 10, the vertical line segments across line 46 representing, as in the remainder of FIG. 9, a many-wired line, containing for example 24 wires. Connector 42 may be a conventional 24-wire plug and socket connector. Similarly, local equipment 52, which in some cases may be a computer, is connected over many-wired line 44, again typically containing 24 wires, to the rear connector 40, which may be like connector 42.

Inside the casing of module 10 are located switch means 54 and associated magnet means 56 to be described in detail hereinafter. An internal many-wired line 58 extends from rear connector 40 to corresponding connecting contacts at front receptacle 22. The wires in line 58 are also connected to one terminal of different ones of a corresponding plurality of magnetically-operable switches comprising the switching means 54, shown schematically as a single switch but actually comprising magnetically-operated switches, such as reed switches, equal in number to the number of wires in line 58. Similarly, internal multiple line 60 extends from rear connector 42 to appropriate contacts at front receptacle chamber 24, and each of the wires in the latter line 60 is also connected to each of the switches constituting switch means 54, at the ends thereof opposite to those to which the wires of line 58 are connected. In addition, the wires of line 60 are connected over a number of corresponding conductors in line 62 to electrical contacts at front receptacle 26.

As it is apparent in FIG. 9, local equipment 52 is normally connected over the 24 conductors of lines 44 and 58, the switch elements of switch means 54, and the 24 conductors of lines 60 and 46, to the modem 50. This may, for example, constitute a normal connection for the equipment, by means of which information derived by modem 50 from audio-frequency tone signals on a common-carrier communications line 63 is normally supplied to the local equipment 52, such as a computer, and by means of which the computer or other local equipment may, if desired, send signals back through the modem to the communications line.

While the connector connections at receptacles 22 and 24 can be used for monitoring or other purposes when switch means 54 is in its normal, closed condition, it is preferred to provide other, separate connector connections at another receptacle 26 for monitoring purposes, since the latter connections will be at all times connected to the line extending to the modem, regardless of the condition of the switch means 54; it would of course be possible to provide a similar monitoring connection permanently connected to line 58, if one wished also to be able always to monitor the leading to the local equipment, but this is often not necessary.

A purpose of the apparatus of the invention in preferred embodiment is to enable an operation in which insertion of a plug, such as a patch-cord plug, into a connecting position in either of receptacles 22 or 24 will not only produce patching-cord connection to the desired line, but will also open all of the contacts of the switch means 54 so as to isolate the local equipment 52 from the modem 50. For example, in the arrangement shown in FIG. 1 the patch-cord plug 28 is inserted into receptacle chamber 22 and the other patch-cord plug 36 is inserted into receptacle chamber 32, whereby the switch connections of switch means 54 in module 10 are opened and the local equipment 52 is now connected to whatever local equipment is connected to the lower rear connector of module 12. As an example only, module 12 may have similar local equipment and modem apparatus connected to its two rear connectors, and inserting the patch cord in the position shown in FIG. 1 will constitute a way of temporarily connecting local equipment 52 to the modem normally associated with module 12, instead of to modem 50, for example as an aid in determining whether there is a fault present in the normally-connected modem 50. In other cases module 12 might have only a spare modem connected to it and no local equipment, so that it would serve merely as a source of a standby modem, whereby the patch cord arrangement shown in FIG. 1 would enable switching to the standby modem for long periods of time, without depriving some other local equipment of its needed modem. There are many other uses which can be made of the equipment, the above being merely representative of some of the many possible uses of the capability of isolating any local equipment and/or modem from its normal partner and instead connecting it to any other equipment as desired, by patching.

Figure 4:
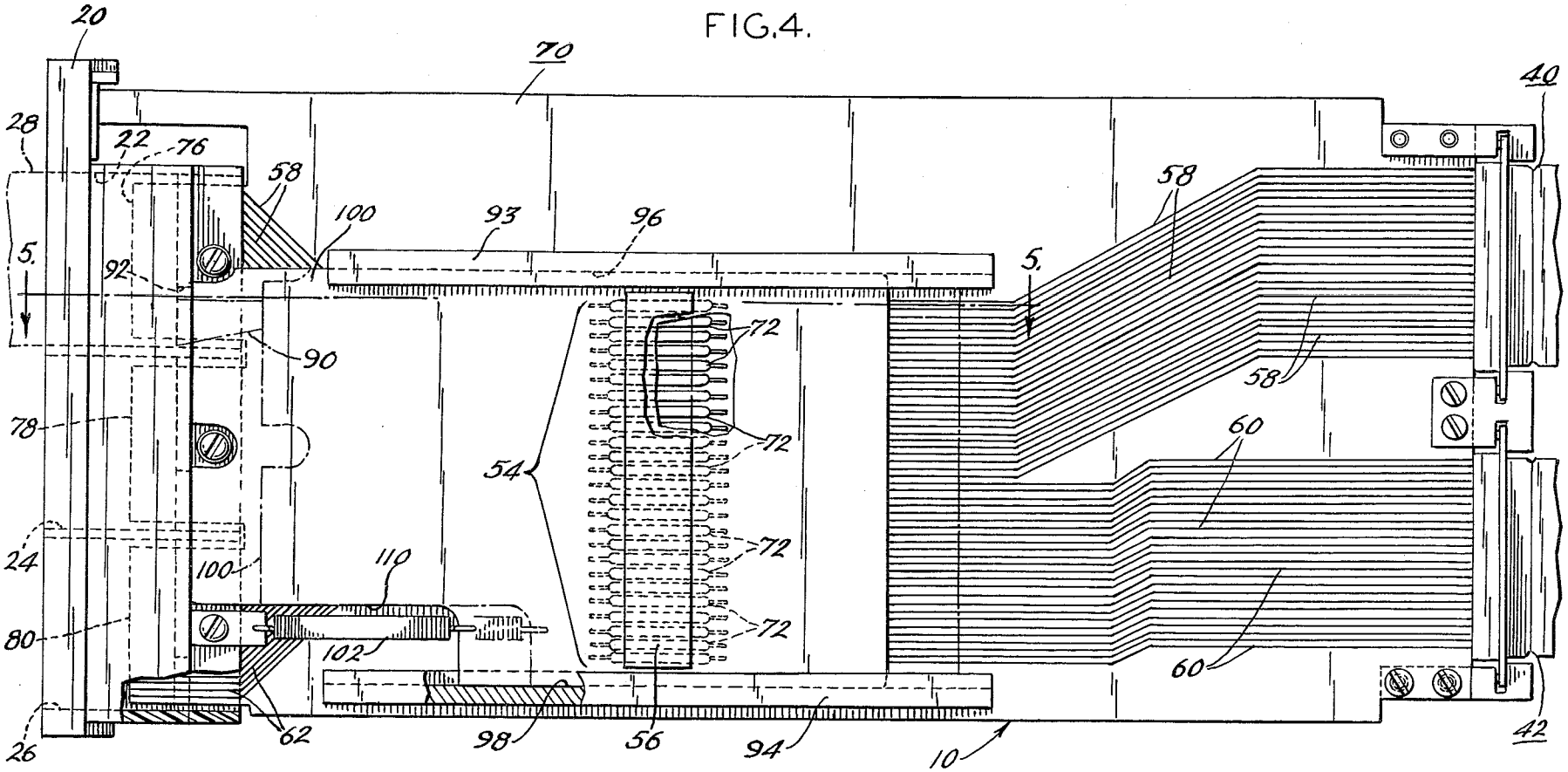
FIG. 4 is a side view of the contents of one of the modules of FIG. 1, constructed in accordance with one embodiment of the invention.
Figure 5:
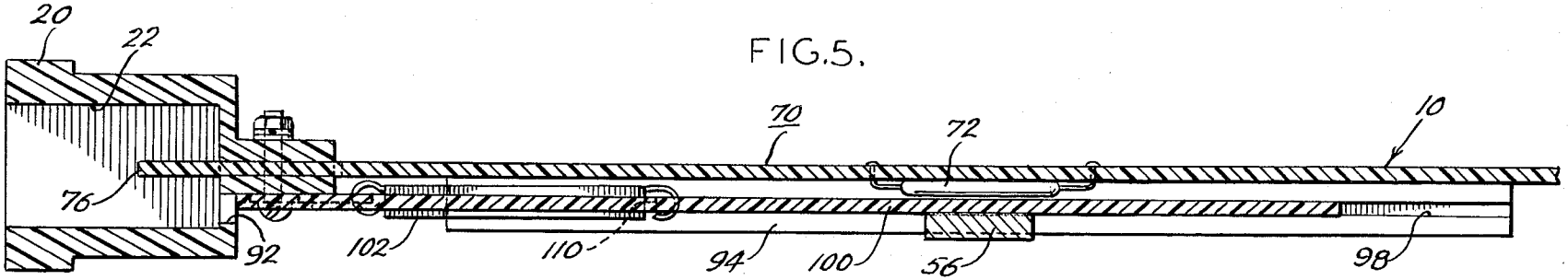
FIG. 5 is a section taken along line 5—5 of FIG. 4, showing the condition of the apparatus when the actuating connector means has not been moved into connecting position in the corresponding receptacle chamber.
Figure 6:
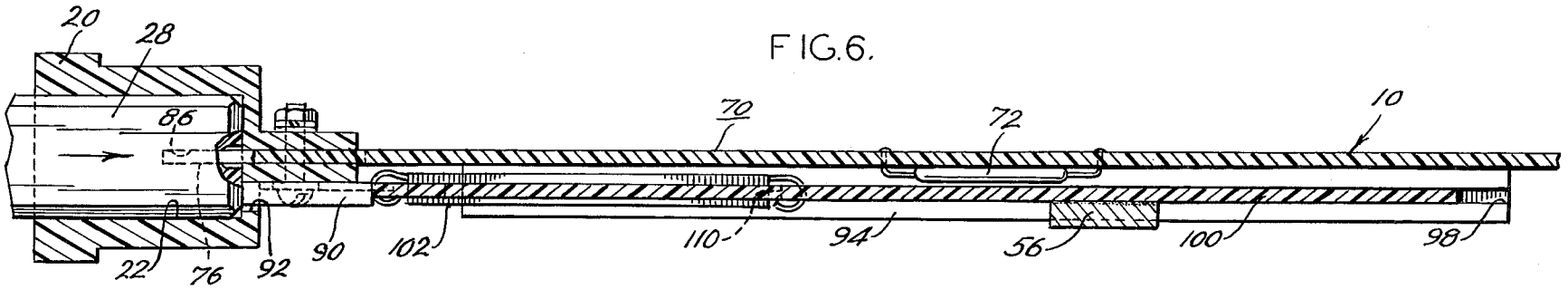
FIG. 6 is a view like that of FIG. 5, but in which the actuating connector has been inserted into position in a receptacle chamber, so as to change the position of the magnet means with respect to the switch means and operate the switch means to their alternate switch state as described fully hereinafter.

Referring now especially to FIGS. 4–6 showing the interior of one preferred embodiment of module 10 with its external casing removed, corresponding parts are again indicated by corresponding numerals. Thus the module 10 contains a circuit board 70 having a single-piece molded plastic receptacle 20 mounted thereto by appropriate screw arrangements at one end, and having the pair of 24-wire connectors 40 and 42 mounted to its opposite end by suitable mounting supports and screws, as shown. The multiconductor internal lines 58 and 60 extending from connectors 40 and 42, respectively, may take any of a variety of forms, including ordinary wires, but conveniently constitute printed-circuit conductor paths on the circuit board 70. As was described above with reference to the schematic of FIG. 9, the multiconductor line 58 extends forwardly to a position at top front receptacle chamber 22, where connection can be made to it by an external patch-cord plug, and multiconductor line 60 similarly extends forward to a position at the central receptacle chamber 24; in addition, a branching line of a equal number of conductors connected to multiconductor line 60 also extends forward to a position at the lower front receptacle chamber 26 to provide a monitoring connection. Each conductor of line 58 is also connected to one terminal of each of a corresponding number of magnetically-operable reed switches such as 72, mounted one above the other in an array extending along, and secured to, circuit board 70, the corresponding opposite ends of each of the reed switches being connected to corresponding respective conductors of multiconductor line 60. These conductors and connections in their physical form are not completely shown in FIG. 4, since it would merely tend to confuse the clarity of the showing, since they can be provided in any conventional manner, and since their electrical arrangement has been explained with respect to FIG. 9. However, one typical preferred arrangement of the conductors at the front end of the circuit board will now be described with reference to FIGS. 4, 5, 7 and 8.

Figure 7:
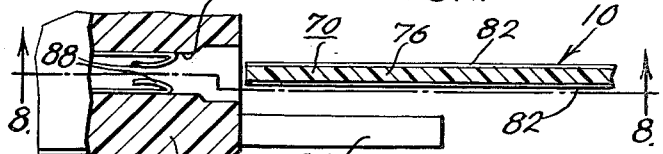
FIG. 7 is a fragmentary view, partly in section, of a patch cord connector means as it is advancing toward its connecting and actuating position with respect to the conductor-carrying panel of FIG. 5.
Figure 8:
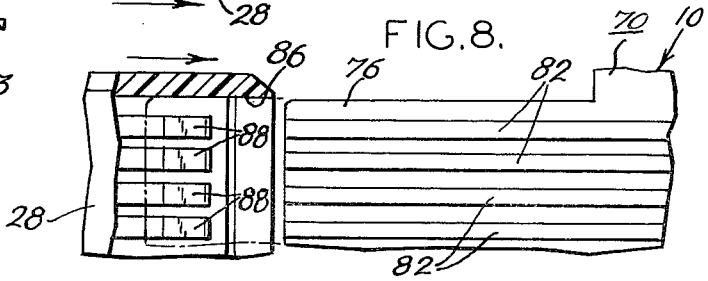
FIG. 8 is a fragmentary sectional view taken along lines 8—8 of FIG. 7.

More particularly, the front end of circuit board 70 is cut out at three positions to form three vertically-separated frontwardly-extending ears 76, 78 and 80. Each of the latter ears extends through a corresponding closely-fitting slot in the rear of receptacle 20, and as shown particularly in FIGS. 7 and 8 is provided on the opposite surfaces thereof with conductors such as 82, constituting the terminal end of the multiconductor line leading to that particular receptacle chamber. In this embodiment it is assumed that 12 of the 24 conductors in each multiconductor line are transferred through appropriate conductive feed-throughs to the opposite side of the circuit board before they reach the corresponding circuit board ears, so that there will be 12 such conductors on one side of each ear and 12 on the other. Each patch-cord plug such as 28 contains a vertical slot, such as 86 in FIG. 7, adapted to receive the corresponding ear and to fit loosely thereover when the plug is inserted into the corresponding receptacle chamber. Along both sides of vertical slot 86 in each patch-cord connector there is disposed a row of spring contacts, such as 88 in FIGS. 7 and 8, each spring contact being aligned with a different one of the cnductors of the corresponding ear, so as to make contact therewith when the plug is placed into its connecting position within the receptacle chamber. Importantly, each patch-cord plug such as 28 is also provided with a forwardly-protruding tab such as 90, which extends freely through an opening 92 in the rear of the receptacle chamber, and as will now be described it is the forward motion of this tab as it is moved into its connecting position which actuates the mechanism for opening the normally-closed switch means 54.

Vertically spaced-apart on one side of circuit board 70 are secured two horizontal track members 93 and 94, containing two respective horizontal grooves 96 and 98 for slidably receiving a vertical panel 100. Panel 100 can be slid forwardly until its forward edge abuts the rear of receptacle 20, and a coil spring 102, secured at one end to the receptacle 20 and at the other end to the panel 100, biases panel 100 toward its forwardmost position. Panel 100 extends over and adjacent the reed switches 72, and a permanent magnet 56 is secured to the outer exposed face of panel 100 by a suitable adhesive, in a position such that when the panel is in its forwardmost position the magnet is aligned with, and overlies, the contacts of each of the reed switches 72. When in this position, the magnet 56 operates in a conventional manner to close the contacts of all of the reed switches, thereby to complete the connections between multiconductor lines 58 and 60.

However, when a patch-cord plug such as 28 is inserted into receptacle chamber 22, the forwardly-extending tab or prong 90 thereof first moves into engagement with the forward end of slidable panel 100 and, as the connector plug is advanced fully into position to make contact with the corresponding conductors on ear 76 of circuit board 70, the corresponding advance of the tab slides the panel 100 to a position further to the right, as shown by dotted line in FIG. 4 and in full line in FIG. 6. As clearly shown for example in FIG. 6, in this actuated position the permanent magnet is no longer in alignment with the contacts of the reed switches, and has in fact been moved so far that it no longer holds the reed switch contacts closed. The reed switches in this example are of conventional type which, in the absence of an applied magnetic field, remain open, and therefore the movement of the permanent magnet to its alternate, actuated position in response to insertion of the connector plug causes the reed switches to open, disconnects multiconductor lines 58 and 60 from each other, and thus permits the patch cord in this example to make connection to line 60 with line 58 disconnected.

Thus in performing the patching operation, it is merely necessary to insert the patch cord manually into the appropriate receptacle, the opening of the internal normally-closed switch means being accomplished automatically in response to the insertion of the plug. Upon removal of the plug, the spring member 102 causes the panel 100 to return to its forwardmost position in which the permanent magnet 56 again closes all of the contacts of switch means 54 to re-establish the normal connection between multiconductor lines 58 and 60, as desired.

Similarly, each of the other receptacle chambers 24 and 26 is provided with an opening permitting passage of the protruding tab 90 when the plug is inserted into that receptacle chamber. In the case of receptacle chamber 22, which is associated with the multiconductor line 58 leading externally to the local equipment in this example, the tab will enagage and move the panel to its actuated, right-most position automatically, to open the internal switch means as desired in such a patching operation. However, when the patch cord is inserted in the lowermost receptacle chamber 26, a cutout 110 in the panel 100 prevents the tab from engaging the panel 100 even when the patch cord is fully inserted, whereby monitoring of the signals on multiconductor line 60 may be accomplished with the switch means 54 in its normally-closed state, and with line 60 therefore in its normal connection to line 58.

The above-described arrangement utilizing a simple permanent magnet affixed to a slidable panel, engaged and actutated by a member secured to the patch-cord plug, has been found reliable, simple, and very convenient for many purposes. However, it would be possible, though generally much less desirable, to use an electromagnet in place of the permanent magnet 56, and the use other types of motions, such as rotary motion, for moving the magnets. The magnets can be mounted for sliding motion by themselves, instead of being mounted on a support which in turn is given a sliding motion. It will be appreciated also that the magnetically-operable switch means may be of a type which is normally closed in the absence of magnetic field, but which opens in response to the magnetic field, in which event in the application described above the magnet would be aligned with the switches in the actuated position of the panel 100, rather than in its normal forward-most position. It is also noted that in the particular embodiment of the invention shown, the patch-cord arrangement is such that an ordinary connector lacking the tab 90 can be inserted into any of the receptacles to make connection with the corresponding multiconductor line when it is not desired to interrupt the normal internal connection of line 58 to line 60; this would, for example, permit monitoring of the lines on both sides of the switches, and provide monitoring connection positions in addition to the one provided at lower-most receptacle 26.

It is of course also possible to move the array of switch contacts while holding the magnet means fixed, it being the relative motion of switch contacts and magnet means which is important in this form of embodiment. In some instances the effect of the magnet means on the switches may be controlled without moving switches or magnets, by controlling the position of a magnetic shield so that it intervenes between switches and magnet means when the magnetic field at the switches is to be reduced and is removed from between switches and magnet means when the magnetic field acting on the switches is to be increased, so as to actuate the switches as desired.

Thus while the invention has been described with particular reference to specific embodiments in the interest of complete definiteness, it will be understood that it may be embodied in a variety of forms diverse from those specifically shown and described, without departing from the spirit and scope of the invention as defined by the appended claims.

What is claimed is:

1. In connecting apparatus of the class comprising: a first plurality of separate conductors; a second plurality of separate conductors; switch means connected between said first plurality of conductors and said second plurality of conductors; a third plurality of separate conductors; quick-disconnect connector means for temporarily connecting said third plurality of conductors to said first plurality of conductors when said connector means is in a first position; and switch actuating means for actuating said switch means between its closed and open states to disconnect said first plurality of conductors from said second plurality of conductors when said connector means is in said first position and to connect said first plurality of conductors to said second plurality of conductors at other times;

the improvement wherein said switch means are magnetically actuatable, and said switch actuating means comprise magnet means positioned adjacent said switch means and means responsive to placing of said connector means into said first position for controlling the effect of said magnet means to actuate said switch means from one of said states to the other.

2. The apparatus of claim 1, wherein said magnet means comprises a permanent magnet.

3. The apparatus of claim 1, wherein said actuating means comprise means supporting said magnet means for motion with respect to said switch means between a first position in which said magnet means causes said switch means to assume one of said states thereof and a second position in which said magnet means causes said switch means to assume the other of said states.

4. The apparatus of claim 3, in which said magnet means comprises a permanent magnet.

5. The apparatus of claim 3, wherein said means responsive to placing of said connector means into said first position comprises engaging means secured to said connector means and positioned to move said magnet means along a predetermined direction as said connector means is advanced into said position.

6. The apparatus of claim 5, wherein said supporting means comprises panel means and means securing said magnet means to said panel means.

7. The apparatus of claim 6, in which said engaging means comprises a tab projecting from said connector means.

8. The apparatus of claim 1, wherein said switch means comprise reed switches.

9. The apparatus of claim 1, comprising additional quick-disconnect connector means for temporarily making connection to said second plurality of conductors when said additional connector means is placed in a first position; and additional switch actuating means for actuating said switch means between its closed and open states when said additional connector means is placed in said first position thereof.

10. The apparatus of claim 9, comprising panel means supporting said magnet means, said additional switch actuating means comprising means for moving said magnet means when said additional connector means is placed in said first position thereof.

11. The apparatus of claim 5, comprising spring-biasing means uring said magnet means along a direction opposite to said predetermined direction so as to return said magnet means to its original position when said connector means is moved out of said position thereof.

12. In a patch-cord system for multi-wire lines:

frame means;

a plurality of magnetically-actuatable switches mounted on said frame means;

a quick-disconnect connector element mounted on said frame;

a first plurality of conductors connected to corresponding contacts of said connector element and also connected to corresponding contacts at one side of said switches;

a second plurality of conductors connected to contacts at the other side of said switches;

a patchcord assembly comprising a multi-wire patch cord and a patch-cord plug at one end thereof, said plug having an engaging surface thereon and adapted to make temporary connection to said contacts of said connector element when placed in position to make connection thereto;

a panel supported slidably on said frame;

magnet means mounted on said panel;

said panel being slidable between a first position in which said magnet means are positioned to cause said switch means to assume their closed states and a second position in which said magnet means are positioned to cause said switch means to assume their open states;

said panel and said connector element being positioned with respect to each other so that as said plug is moved into said connecting position thereof, said engaging surface of said plug moves said panel from said first position thereof to said second position thereof; and spring means for returning said panel to said first position thereof when said plug is removed from said connecting position thereof.

13. The apparatus of claim 12, wherein said plug comprises a protruding tab, and said engaging surface is on said tab.

14. The apparatus of claim 13, in which said magnet means comprises permanent magnet means.

15. The apparatus of claim 14, in which switches comprise a plurality of reed switches.

* * * * *